US008950491B2

(12) United States Patent
Frost

(10) Patent No.: US 8,950,491 B2
(45) Date of Patent: Feb. 10, 2015

(54) DOWNHOLE ASSEMBLY FOR TREATING WELLBORE COMPONENTS, AND METHOD FOR TREATING A WELLBORE

(71) Applicant: Odessa Separator, Inc., Odessa, TX (US)

(72) Inventor: Cavin B. Frost, Odessa, TX (US)

( * ) Notice: Subject to any disclaimer, the term of this patent is extended or adjusted under 35 U.S.C. 154(b) by 261 days.

(21) Appl. No.: 13/686,162

(22) Filed: Nov. 27, 2012

(65) Prior Publication Data

US 2013/0327528 A1 Dec. 12, 2013

Related U.S. Application Data

(60) Provisional application No. 61/583,752, filed on Jan. 6, 2012.

(51) Int. Cl.
*E21B 43/22* (2006.01)
*E21B 37/06* (2006.01)

(52) U.S. Cl.
CPC ..... *E21B 37/06* (2013.01)
USPC ..... 166/304; 166/310

(58) Field of Classification Search
USPC ..... 166/300, 304, 310, 369, 910, 902
See application file for complete search history.

(56) References Cited

U.S. PATENT DOCUMENTS

| | | | | |
|---|---|---|---|---|
| 2,437,475 | A | 3/1948 | Oxford | |
| 4,032,457 | A | 6/1977 | Matchett | |
| 5,114,540 | A | 5/1992 | Law | |
| 5,893,416 | A | 4/1999 | Read | |
| 7,195,070 | B2 * | 3/2007 | Delaloye et al. | 166/304 |
| 7,406,887 | B2 | 8/2008 | Jensen | |
| 7,413,009 | B2 | 8/2008 | Jacobs et al. | |
| 7,493,955 | B2 | 2/2009 | Gupta et al. | |
| 7,503,389 | B2 * | 3/2009 | Delaloye et al. | 166/304 |
| 7,994,103 | B2 | 8/2011 | Campbell et al. | |
| 2004/0084186 | A1 | 5/2004 | Allison | |
| 2007/0039739 | A1 * | 2/2007 | Wilson | 166/369 |
| 2011/0162841 | A1 | 7/2011 | Wilson | |
| 2012/0012326 | A1 | 1/2012 | Darby et al. | |
| 2013/0075090 | A1 * | 3/2013 | Woiceshyn | 166/250.12 |

OTHER PUBLICATIONS

Slides from ConocoPhillips Gas Well Deliquification Workshop (Feb. 19-22, 2012).

Magazine ad One Treatment When You Frac. Fewer Interventions After You Frack. © 2012 Baker Hughes Incorporated. 36204 Aug. 2012.

T. Smith, S. Szymczak, D.V. Satya Gupta and M. Brown, Solid Paraffin Inhibitor, SPE Paper No. 124868 (2009 (10 pages).

* cited by examiner

*Primary Examiner* — William P Neuder

(74) *Attorney, Agent, or Firm* — Buskop Law Group, PC; Wendy Buskop

(57) ABSTRACT

A downhole assembly for delivering chemical treatment to a wellbore at the level of a hydrocarbon-bearing formation is provided. The chemical treatment is in solid phase, and slowly dissolves when exposed to wellbore fluids. A method of treating a wellbore using a solid chemical is also provided.

39 Claims, 7 Drawing Sheets

DOWNHOLE ASSEMBLY FOR TREATING WELLBORE COMPONENTS, AND METHOD FOR TREATING A WELLBORE

CROSS REFERENCE TO RELATED APPLICATIONS

This application claims the benefit of a provisional patent application filed on 6 Jan. 2012, entitled "Downhole Assembly for Treating Wellbore Components, and Method for Treating a Wellbore." That application has U.S. Ser. No. 61/583,752, and is incorporated herein by reference in its entirety.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

1. Field of the Invention

The present disclosure relates to the field of hydrocarbon recovery operations. More specifically, the present invention relates to a downhole tool used for treating a wellbore. The application also relates to methods for delivering a chemical treatment to a wellbore below the surface.

2. Technology in the Field of the Invention

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the surrounding formations.

A cementing operation is typically conducted in order to fill or "squeeze" the annular area with columns of cement. The combination of cement and casing strengthens the wellbore and facilitates the zonal isolation of the formations behind the casing.

It is common to place several strings of casing having progressively smaller outer diameters into the wellbore. A first string of casing may be referred to as a conductor pipe or surface casing. This casing string serves to isolate and protect the shallower, fresh water-bearing aquifers from contamination by any other wellbore fluids. Surface casing strings are almost always cemented entirely back to the surface.

The process of drilling and then cementing progressively smaller strings of casing is repeated several times until the well has reached total depth. In some instances, the final string of casing is a liner, that is, a string of casing that is not tied back to the surface. The final string of casing, referred to as a production casing, is also typically cemented into place.

Additional tubular bodies may be included in a well completion. These include one or more strings of production tubing placed within the production casing or liner. Each tubing string extends from the surface to a designated depth proximate a production interval, or "pay zone." Each tubing string may have a packer attached at a lower end. The packer serves to seal off the annular space between the production tubing string(s) and the surrounding casing. In this way production fluids are directed up the tubing string.

In some instances, the pay zones are incapable of flowing fluids to the surface efficiently. When this occurs, the operator may include artificial lift equipment as part of the wellbore completion. Artificial lift equipment may include a downhole pump connected to a surface pumping unit via a string of sucker rods run within the tubing. Alternatively, an electrically-driven submersible pump may be placed at the bottom end of the production tubing. Gas lift valves, plunger lift systems, or various other types of artificial lift equipment and techniques may alternatively be employed to assist fluid flow to the surface.

As part of the completion process, a wellhead is installed at the surface. The wellhead includes piping and valves used for directing the flow of production fluids at the surface. The wellhead also contains wellbore pressures.

Fluid gathering and processing equipment is also provided at the surface. Such equipment may include pipes, valves, separators, dehydrators, gas sweetening units, and oil and water stock tanks. Upon installation of the wellhead and other surface equipment, production may begin.

During the production of hydrocarbons from the pay zones, some wells experience a build-up of scale. This may be due to the presence of dissolved minerals in oil and water produced by oil and gas wells. Changes in temperature and/or pressure which occur as production fluids are pumped from the production zone to the surface can cause the inorganic minerals to come out of solution ("precipitate") and become deposited on the interior and exterior surfaces of production hardware. Such hardware may include the production tubing, downhole pumps, surface valves, and other equipment.

Scale is typically in the form of a mineral salt that deposits on the surface of metal or other material. Typical scales are calcium carbonate, calcium sulfate, barium sulfate, strontium sulfate, iron sulfide, iron oxides, iron carbonate, the various silicates and phosphates and oxides, or any of a number of compounds insoluble or slightly soluble in water. The presence of mineral salts can also create corrosion on metal surfaces.

In severe conditions, scale creates a significant restriction, or even a plug, in the production tubing and pump orifices. Scale build-up in an artificial lift pump can lead to failure of the pump due to blocked flow passages and broken shafts. In addition, scale can clog perforations, requiring that a well be treated or even re-perforated.

All waters used in well operations can be potential sources of scale. These include water used in waterflood operations and filtrate from completion, workover or treating fluids. For these and the other reasons mentioned, scale removal is a common well-intervention operation.

A wide range of treatment options are available to effect scale removal. These include mechanical removal, chemical treatment, and corrosion inhibitor treatment.

Mechanical removal may be done by means of a pig that is pumped downhole. Alternatively, mechanical removal may involve abrasive jetting that hydraulically cuts scale but leaves the tubing intact. Of course, such mechanical processes do not protect a submersible pump from scale during production operations, nor do they prevent any future build-up of corrosion.

Scale-inhibition treatments involve squeezing a chemical inhibitor into a water-producing zone for subsequent commingling with produced fluids. The scale inhibitor prevents further scale precipitation along producers. However, such a technique is imprecise as it is unknown how much of the inhibitor will make its way back to the wellbore, or when.

Chemical removal is performed by using different solvents according to the type of scale that is presented. Sulfate scales such as gypsum [$CaSO_42H_2O$] or anhydrite [$CaSO_4$] can be dissolved using ethylene-diamine tetra-acetic acid (EDTA). Carbonate scales such as calcium carbonate or calcite [$CaCO_3$] can be dissolved with hydrochloric acid [HCl] at temperatures less than 250° F. [121° C.]. Silica scales such as crystallized deposits of chalcedony or amorphous opal normally associated with steam flood projects can be dissolved using hydrofluoric acid [HF]. Chloride scales such as sodium chloride [NaCl] may be dissolved using fresh water or weak acidic solutions, including HCl or acetic acid. Iron scales such as iron sulfide [FeS] or iron oxide [$Fe_2O_3$] can usually be dissolved using HCl with sequestering or reducing agents to avoid precipitation of by-products, for example iron hydroxides and elemental sulfur.

In the oil fields of West Texas and other areas where water flooding takes place, calcium sulfate and calcium carbonate scales can appear. Calcium scales such as calcium sulfate, calcium carbonate and calcium oxalate are insoluble in water. However, all three are soluble in a Sodium Bisulfate acid solution. Calcium scale can be removed with an acid wash using a 5 to 15% solution of Sodium Bisulfate (SBS). SBS can also be used during a shutdown to remove scale by re-circulating it throughout areas of the process where needed. The concentration of SBS solutions and the re-circulation time depend on the amount of scale that needs to be removed.

Sulfamic acid ($H_3NSO_3$) may also be used in calcium scale (or lime) removal situations. Sulfamic acids include amidosulfonic acid, amidosulfuric acid, aminosulfonic acid, and sulfamidic acid. Sulfuric acids ($H_2SO_4$) may also be considered. Sulfamic acids can slowly hydrolyze to ammonium bisulfate in the presence of water.

The delivery of chemical to a wellbore is normally done by placing the chemical in liquid form into the wellbore. However, it is believed that such chemical delivery is frequently ineffective as it is difficult to assure that the treatment is reaching the lowest portions of the wellbore where it is needed most.

Recently, Baker Hughes, Inc. has developed a Sorb™ or ScaleSorb™ process for injecting solid pellets and liquid comprising scale inhibitor or other chemical material into a subsurface formation. The inhibitors are typically injected as part of the initial formation fracturing process. The chemicals treat formation fluids before they arrive at the wellbore. Baker Hughes advertises that its Sorb™ chemicals inhibit scale, paraffin, asphaltenes, and salt; they counteract bacteria and corrosion. However, this process is a one-time injection that depends on the chemical treatment contacting all fluids produced to the wellbore.

Therefore, a need exists for a downhole assembly that will slowly deliver chemical treatment at the level of production perforations, or at or below the level of a pump. Further, a need exists for an assembly and method for using a continuous solid chemical that directly treats a wellbore as the solid material dissolves in the presence of wellbore fluids.

BRIEF SUMMARY OF THE INVENTION

A downhole assembly for delivering chemical treatment to a wellbore is provided herein. The chemical treatment is delivered along the wellbore at the level of a hydrocarbon-bearing formation. The chemical treatment serves to inhibit the build-up of scale or other material along wellbore components during the production of reservoir fluids.

The assembly includes a first tubular body and a second tubular body. In one embodiment, the second tubular body resides substantially within the first tubular body in concentric fashion. In this way, an annular region is formed between the second tubular body and the surrounding first tubular body.

The second tubular body is porous. The second tubular body may be, for example, a perforated tubing. Alternatively, the second tubular body may define a screen. Either way, fluid communication is provided between the first tubular body and a bore within the second tubular body.

The assembly also includes a chemical treating material. The chemical treating material is in solid phase, but is dissolvable upon contact with reservoir fluids. The chemical treating material is designed to (i) inhibit a build-up of precipitate on components in the wellbore, (ii) remove scale and corrosion on components in the wellbore, or (iii) combinations thereof. Alternatively, the chemical treating material is designed to prevent a build-up of paraffin or bacteria along the wellbore.

The chemical treating material preferably resides within the bore of the second tubular body. In this instance, the chemical treating material may be in the form of a solid cylindrical "stick." The stick would represent one or more cylinders stacked within the downhole assembly. As reservoir fluids are produced from a subsurface formation, the fluids contact the "stick," causing the chemical treating material to slowly dissolve.

In one aspect, the downhole assembly further includes a blank pipe section that is placed at an end of the second tubular body. One or more cylinders are stacked within the blank pipe. This adds volume to the solid chemical treating material within the downhole assembly.

In another embodiment of the downhole assembly, the first tubular body is a blank pipe. In this instance, the chemical treating material is preferably placed in an annular region formed between the second tubular body and the surrounding first tubular body. The chemical treating material may then be in the form of one or more donut-shaped discs. A porous tubular body may optionally be placed on either or both ends of the second tubular body. This allows reservoir fluids to enter the bore of the second tubular body and make fluidic contact with the solid chemical treating material from the inside out.

In one aspect, the assembly resides below a reciprocating pump within a wellbore.

A method of treating a wellbore using a solid chemical is also provided herein. The chemical treatment is delivered along the wellbore at the level of a hydrocarbon-bearing formation, preferably below a downhole pump. The chemical treatment serves to inhibit the build-up of scale or other selected contaminant along wellbore components during the production of reservoir fluids.

The method includes running a downhole assembly into a wellbore. The downhole assembly is designed in accordance with the downhole assembly described above in its various embodiments.

The method also includes threadedly connecting the downhole assembly to a wellbore component. The wellbore component may be, for example, the lower end of a seating nipple. Alternatively, the wellbore component may be a joint of production tubing. The method then includes running the downhole assembly into the wellbore.

The method may then include producing hydrocarbon fluids from the wellbore.

BRIEF DESCRIPTION OF THE DRAWINGS

So that the manner in which the present invention can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
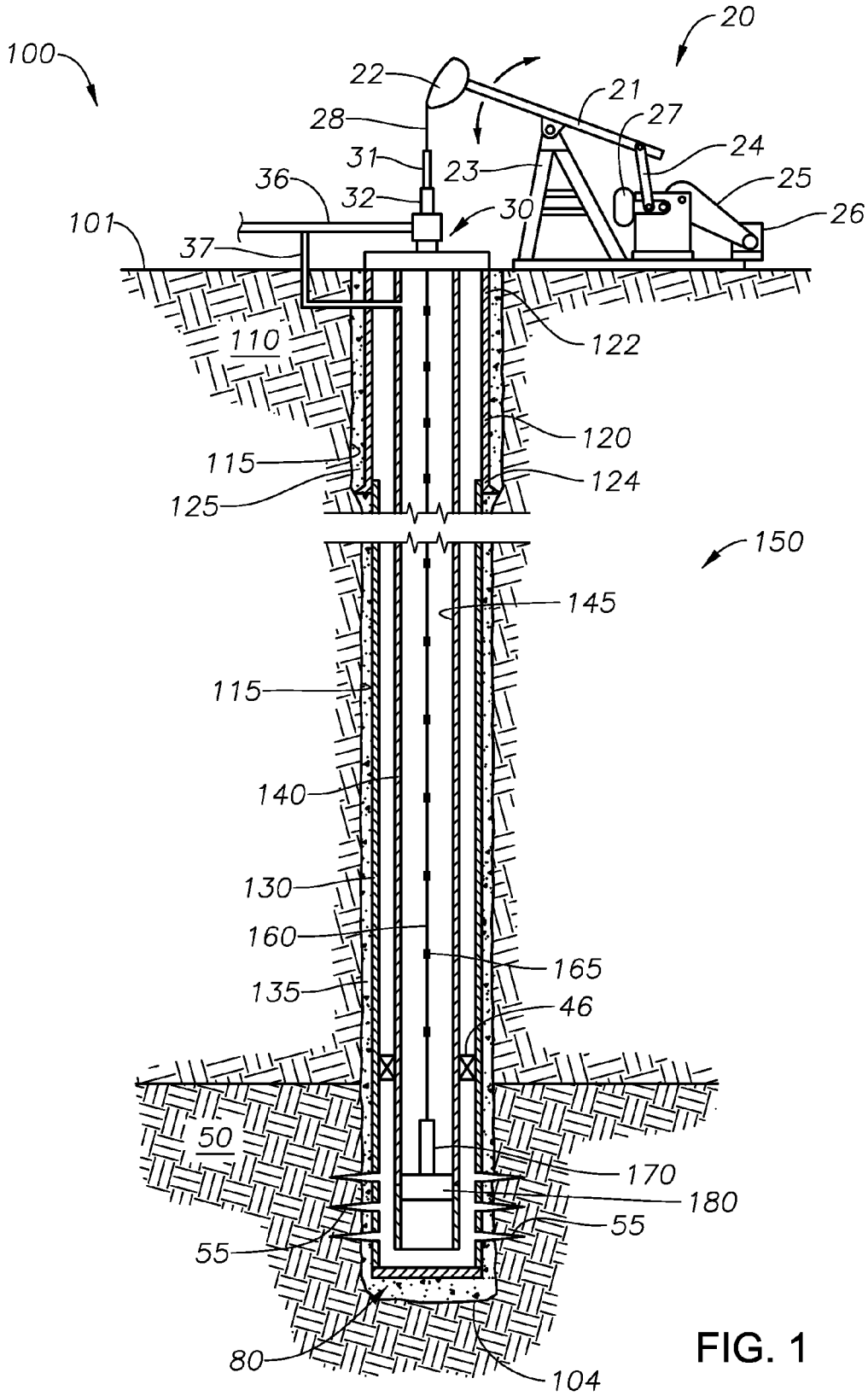
FIG. 1 is a side, cross-sectional view of a well site constructed for hydrocarbon production. The well site includes a wellbore that has a downhole chemical delivery assembly for treating wellbore components therein.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation, a conventional sandstone or carbonate formation, or a so-called unconventional shale or other low permeability formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, combinations of liquids and solids, and combinations of gases, liquids, and solids.

As used herein, the term "gas" refers to a fluid that is in its vapor phase at about 1 atm and 15° C.

As used herein, the term "oil" refers to a hydrocarbon fluid containing primarily a mixture of condensable hydrocarbons.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

The terms "zone" or "pay zone" or "zone of interest" refer to a portion of a formation containing hydrocarbons. Alternatively, the formation may be primarily a water-bearing interval.

For purposes of the present patent, the term "production casing" includes a liner string or any other tubular body fixed in a wellbore along a zone of interest.

The term "hydrocarbon-bearing formation" refers to a zone of interest or pay zone containing hydrocarbon fluids.

As used herein, the term "precipitate" means any substance precipitated from a wellbore fluid. Precipitates may include, for example, paraffin, waxes, scale, and iron sulfide.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore."

Description of Selected Specific Embodiments

FIG. 1 provides a side, cross-sectional view of a well site 100 constructed for hydrocarbon production. The well site 100 generally includes a wellbore 150 and a wellhead 20. The wellbore 150 includes a bore 115 for receiving completion equipment and fluids. The bore 115 extends from a surface 101 of the earth, and down into the earth's subsurface 110.

The wellbore 150 is first formed with a string of surface casing 120. The surface casing 120 has an upper end 122 in sealed connection with the well head 20. The surface casing 120 also has a lower end 124. The surface casing 120 is secured in the wellbore 150 with a surrounding cement sheath 125. The cement sheath 125 resides in an annular region formed between the surface casing 120 and the surrounding earth subsurface 110.

The wellbore 150 also includes a lower string of casing 130. The lower string of casing 130 is also secured in the wellbore 150 with a surrounding cement sheath 135. The lower string of casing 130 extends down to a bottom 104 of the wellbore 150. The lower string of casing 130 traverses a hydrocarbon-bearing formation 50. Therefore, the lower string of casing 130 is referred to as production casing.

It is understood that the wellbore 150 may and likely will include at least one additional string of casing (not shown) residing between the surface (or conductor) casing 120 and the lower (or production) casing 130. These intermediate strings of casing may be hung from the surface. Alternatively, they may be hung from a next higher string of casing using a liner hanger. It is understood that the present inventions are not limited to the type of casing arrangement used.

The wellbore 150 also includes a string of production tubing 140. The production tubing 140 extends from a tubing hanger 30 at the well head 20, down proximate to the hydrocarbon-bearing formation 50. The production tubing 140 includes a bore 145 that transports production fluids from the hydrocarbon-bearing formation 50 up to the well head 20.

The wellbore 150 further has a production packer 146. The production packer 146 sits just above or proximate to the top of the formation 50 and seals an annular area between the production tubing 140 and the surrounding casing 130. The production packer 146 keeps reservoir fluids from migrating behind the tubing 140 during production.

Encased within the production tubing 140 is a pump 170. The pump 170 may be any type of pump used for lifting production fluids up to the surface 101. The pump 170 may be, for example, an electrical submersible pump, a jet pump, a gas lift, or a hydraulic pump. In the specific arrangement of FIG. 1, the pump 170 is a positive displacement pump that is reciprocated using a string of sucker rods 160.

The sucker rods 160 represent slender joints of pipe that are typically 25 or 30 feet (7.62 or 9.14 meters) in length. The joints are connected end-to-end through threaded couplings 165. The sucker rods 160 extend from the surface 101 to the formation 50 and support the pump 170.

In order to provide fluid communication between the hydrocarbon-bearing formation 50 and the production tubing 140, the production casing 130 has been perforated. A series of perforations are shown at 55. It is understood that the wellbore 150 may be completed using a pre-perforated pipe, a sand screen, a gravel pack, or some combination thereof in lieu of perforated casing.

As noted, the well site 100 also includes a well head 20. In the illustrative well site 100, the well head 20 represents a pumping unit known as a "pump jack." The pump jack produces an up-and-down motion for reciprocating the sucker rods 160 and connected pump 170. The pump jack includes known components such as a walking beam 21, a horse head 22, and supporting Samson posts 23. The pump jack further includes a Pitman arm 24, a v-belt 25 and a prime mover (an electric motor or an internal combustion engine) 26 for turning the v-belt 24. The pump jack also includes a rotating counter-weight 27 that assists in providing mechanical advantage for reciprocating the horse head 22 and a connected bridle 28.

The well head 20 also includes a polished rod 31. The polished rod 31 connects the bridle 28 with the sucker rods 160. The polished rod 31 is received within a stuffing box 32. The pump jack, the polished rod 31, and the stuffing box 32 are all well-known components for producing hydrocarbons to the surface 101.

The well head 20 will also include various valves and flow lines for controlling the flow of production fluids at the surface. These may include separate oil 36 and gas 37 production lines.

It is understood that the well site 100 arrangement of FIG. 1 is merely illustrative. In some instances, the hydrocarbon-bearing formation 50 will possess sufficient reservoir pressure to allow production fluids to be produced to the surface 101 without need of a fluid pump 170, sucker rods 160, and the pumping unit. In that instance, a well head having a crown valve and/or master valves will be sufficient. Alternatively, a hydraulic pumping system may be employed that uses a hydraulic pump to cyclically pump fluid into a cylinder (not shown) above the wellbore 150. The fluid acts against a piston within the cylinder, causing the piston and the connected polished rod 31 and rod string 160 to reciprocate.

In any of these instances, it is oftentimes desirable to treat the wellbore components (such as the production tubing 140 and the pump 170) for scale or corrosion. Treating may mean preventing a build-up of scale or corrosion; alternatively, treating may mean reducing or removing scale that is present. Therefore, the wellbore 150 of FIG. 1 contains a novel downhole chemical delivery assembly 180.

The chemical delivery assembly 180 preferably resides below the pump 170. In the arrangement of FIG. 1, the chemical delivery assembly 180 resides below and is connected to a seating nipple (not shown) below the pump 170. The chemical delivery assembly 180 is designed to provide a solid chemical that slowly dissolves upon contact with hydrocarbon fluids such as brine. Beneficially, the chemical delivery assembly 180 is preferably disposed at or near the bottom 104 of the bore 115 so that treatment may be provided to downhole components and the entire production tubing 140.

Figure 2A:
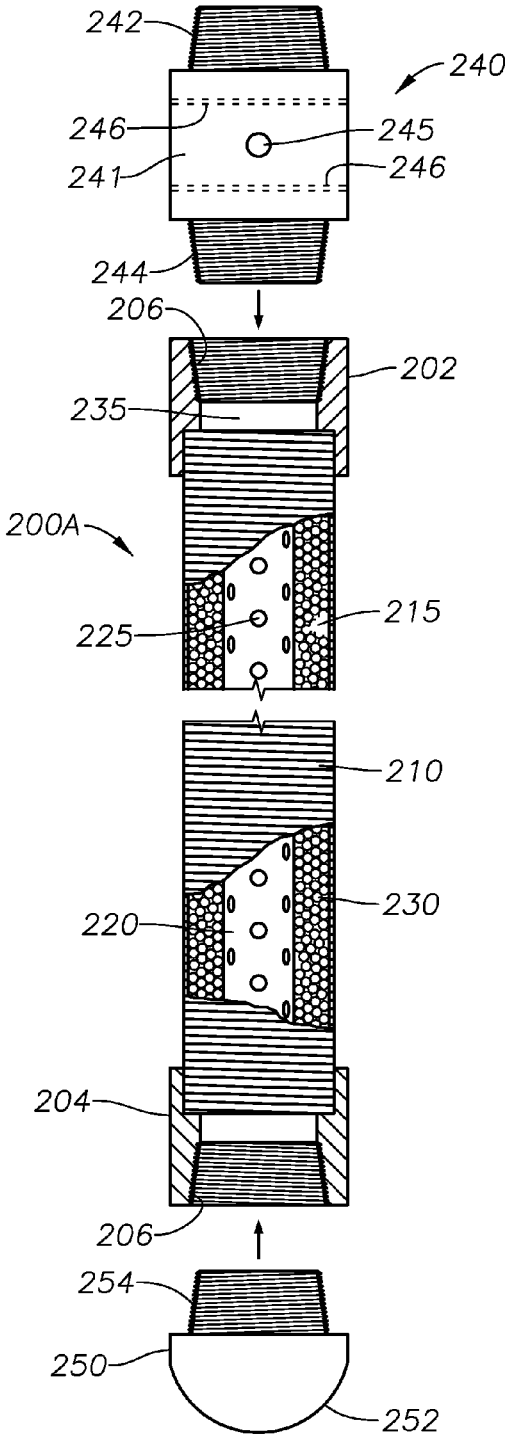
FIG. 2A is a side view of a downhole chemical delivery assembly for treating wellbore components of the present invention, in one embodiment. Portions of the chemical delivery assembly are cut away and exploded apart to better show individual components. Pellets are shown for the chemical treating material.

FIG. 2A is a side view of a downhole chemical delivery assembly 200A for treating wellbore components of the present invention, in one embodiment. Portions of the chemical delivery assembly 200A are cut away and exploded apart to better show individual components.

The chemical delivery assembly 200A first includes a screen 210. The screen 210 has an upper end 202 and a lower end 204. In the arrangement of FIG. 2A, the upper 202 and lower 204 ends define threaded half-collars that have been welded or otherwise connected to the screen 210. Each half-collar presents female threads 206 for connecting with other components.

The chemical delivery assembly 200A also includes a string of tubing 220. The tubing 220 contains perforations 225 to provide fluid communication between wellbore fluids and a bore 235 of the tool 200A. An annular region 215 is formed between the perforated tubing 220 and the surrounding screen 210.

Residing within the annular region 215 is a chemical treating material. The chemical treating material is shown in FIG. 2A in the form of pellets 230. However, the chemical treating material may alternatively be in a continuous solid form. For example, the chemical treating material may be shaped as donuts or discs. One or more discs may be stacked over the perforated tubing 220 and in the annular region 215.

Figure 2C:
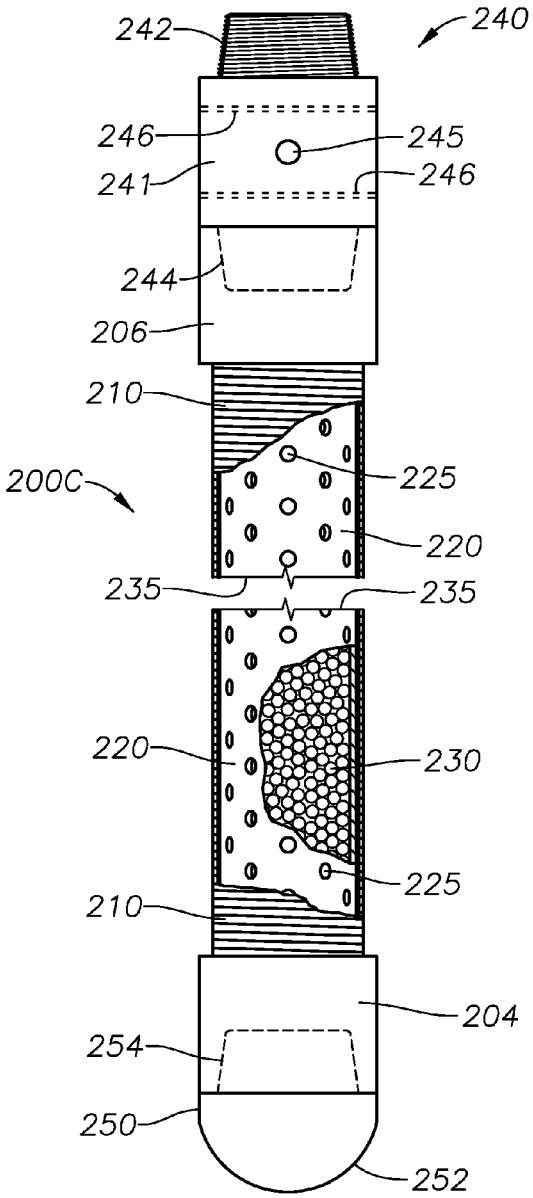
FIG. 2C is a side view of the downhole chemical delivery assembly of FIG. 2A, in a modified embodiment. Portions of the chemical delivery assembly are torn away to better show individual components.
Figure 2B:
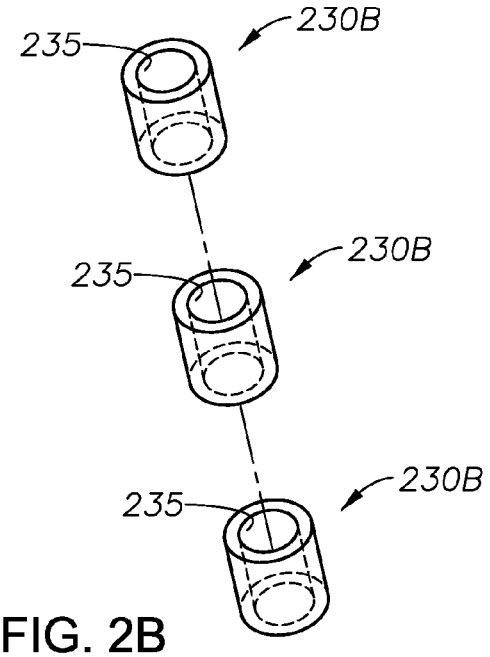
FIG. 2B is a perspective view of a continuous solid material as may be used as the chemical treating material of the downhole chemical delivery assembly of FIG. 2A. Here, the chemical treating material is in the form of donut-shaped discs.

FIG. 2B is a perspective view of a continuous solid material as may be used as the chemical treating material of the downhole chemical delivery assembly of FIG. 2A. Here, the chemical treating material is in the form of a series of donut-shaped discs 230B. Each disc 230B has a bore 235 dimensioned to receive the perforated tubing 220. The discs 230B are stacked within the annular region 215 according to a desired length. The discs 230B serve as an alternative to the pellets 230 of FIG. 2A.

The chemical delivery assembly 200A also includes a bull plug 250. The bull plug 250 contains threads 254 for connecting with threads 206 within the half-collar at the lower end 204 of the assembly 200A. The bull plug 250 seals the lower end 204 of the assembly 200A. Specifically, the bull plug 250 holds the pellets 230 (or other solid chemical treating material) within the annular region 215.

It is noted that the bull plug 250 defines a nose 252. The nose 252 is preferably dimensioned to fit flush with an outer diameter of the half-collar of the lower end 204 when the bull plug 250 is tightened down onto the lower end 204. In this way, the chemical delivery assembly 200A will not get hung up on wellbore components during run-in or pull-out.

The chemical delivery assembly 200A also has an optional no-flow nipple 240. The no-flow nipple 240 defines a body 241 that has a threaded upper end 242 for connecting to a landing nipple or production tubing 160 in a wellbore. The no-flow nipple 240 also has a lower end 244 for threadedly connecting with threads 206 in the half-collar at the upper end 202 of the screen 210.

As the name suggests, the no-flow nipple 240 restricts the flow of fluids, serving to seal the top end of the assembly 200A. A pair of blank plates 246 is provided to form the seal. The blank plates 246 are shown in phantom in FIG. 2A. A through-opening 245 is drilled through the no-flow nipple 240 between the plates 246. This optional feature is simply to indicate that the nipple 240 is not a typical tubing nipple.

In one aspect, a novel collar (not shown) is placed at either end of the chemical delivery assembly 200A. This is in lieu of the no-flow nipple 240 at the upper end and/or the bull plug 250 at the lower end. The collar is a socket welded collar with female threads, not unlike the half-collar shown at the upper 202 and lower 204 ends of the screen 210. A solid disc plug is then threaded into the collar using a special tool. This makes it impractical for a workover crew at the well site to improvidently open the chemical delivery assembly 200A at an end and dump chemical material 230.

With all components connected, the chemical delivery assembly 200A may be anywhere from 8 feet to 40 feet (2.44 to 12.19 meters) in length. It is understood that a longer assembly 200A, particularly a longer screen 210, will have a greater annular volume for containing the chemical treating material 230. Optionally, the screen 210 may be jointed, allowing for the connection of multiple screen sections along the wellbore.

In one aspect, two chemical delivery assemblies 200A may be spaced along a wellbore to treat a particularly long section of a pay zone. For example, in the case of a deviated or horizontally completed well, different screen joints may be placed between perforated sections of casing or between sand screen joints to enable greater treatment of the wellbore components along the pay-zone. However, it is preferred that the chemical delivery assembly 200A be placed at the bottom of the tubing string and below pump intake and never support any weight.

It is understood that other components may be used for connecting the chemical delivery assembly 200A with the production string. In this respect, the screen 210 may not be strong enough to support the threaded half collar 206 and connected components. Therefore, some other connection, such as a welded or threaded connection with the perforated tubing 220 may be needed.

FIG. 2C is a side view of the downhole chemical delivery assembly of FIG. 2A, in a modified embodiment. The chemical delivery assembly is indicated at 200C. Portions of the chemical delivery assembly 200C are torn away to better show individual components. However, the components are not exploded apart as they are in FIG. 2A.

The tool 200C of FIG. 2C is generally designed in accordance with the tool 200A of FIG. 2A. Like parts are indicated using like reference numbers. For example, the tool 200C includes a screen 210, a section of perforated tubing 220 within the screen 210, a half-collar at an upper end 202 of the screen 210, a no-flow nipple 240 above the upper end 202 of the screen 210, another half-collar at a lower end 204 of the screen 210, and a bull plug 250 at the bottom of the chemical delivery assembly 200C.

However, in FIG. 2C, the tool 200C does not employ a significant annulus between the perforated tubing 220 and the surrounding screen 210. This means that the pellets (or other solid chemical) 230 do not reside in an annular region as they do in FIG. 2A. Instead, the pellets 230 reside within the perforated tubing 220 itself.

The perforated tubing 220 may be a standard size tubing, such as 2⅜ inches or 2⅞ inches inner diameter. The screen 210 has an inner diameter that closely fits over the outer diameter of the tubing 220. Preferably, longitudinal ribs (shown in FIG. 4B) provide spacing and support between the tubing 220 and the surrounding screen 210.

In FIG. 2C, a portion of the perforated tubing 220 is torn away. A plurality of packed pellets 230 are seen. As fluids are produced from the wellbore, the wellbore fluids flow through the filtering screen 210, through the perforations 225 in the tubing 220, and into the bore 235 of the tubing 220. There, the wellbore fluids contact the pellets 230.

As the pellets 230 are contacted by water or other hydrocarbon fluids, the chemical treating material making up the pellets 230 is dissolved. The dissolved chemical treating material slowly migrates out of the chemical delivery assembly 200A or 200B, and intermingles with the wellbore fluids. The chemical treating material is then able to treat production components such as a downhole pump, production tubing, and surface valves and pipes. In this way, the chemical delivery assembly 200A or 200C acts as something of a "tea bag."

Figure 2D:
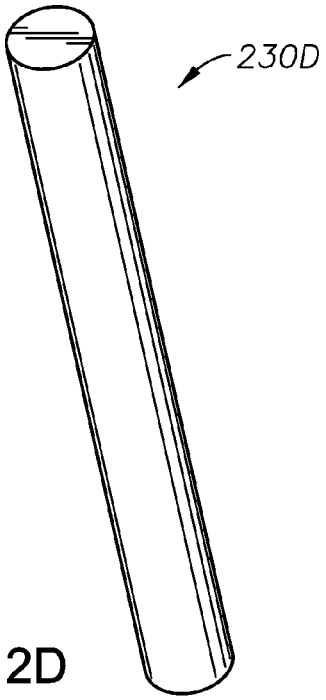
FIG. 2D is a perspective view of a continuous solid material as may be used as the chemical treating material of the downhole chemical delivery assembly of FIG. 2C. Here, the chemical treating material is in the form of a "stick" having a circular profile.

It is noted that the chemical treating material of FIG. 2C may be a continuous solid material rather than pelletized solid material. FIG. 2D is a perspective view of a continuous solid material as may be used as the chemical treating material of the downhole chemical delivery assembly of FIG. 2C. Here, the chemical treating material is in the form of a "stick" 230D. The stick has a circular profile that generally conforms to the inner diameter of the perforated tubing 220. The stick 230D may represent a single elongated cylinder that extends along the length of the perforated tubing 220, or it may be a series of cylindrical bodies that are stacked according to a desired length.

The composition of the chemical treating material making up the discs 230B or the sticks 230D may be adjusted to provide treatment for different types of scale, corrosion, paraffin, or iron sulfide. In the case of scale, a corrosion inhibitor is employed in the solid chemical treating material. Corrosion inhibitors may be selected from the group consisting of carboxylic acids and derivatives such as aliphatic fatty acid derivatives, imidazolines and derivatives; including amides, quaternary ammonium salts, amines, pyridine compounds, rosin derivatives, trithione compounds, heterocyclic sulfur compounds, quinoline compounds, or salts, quats, or polymers of any of these, and mixtures thereof. In addition, suitable inhibitors may include primary, secondary, and tertiary monoamines; diamines; amides; polyethoxylated amines, diamines or amides; salts of such materials; and amphoteric compounds. Other examples include imidazolines having both straight and branched alkyl chains, phosphate esters, and sulfur containing compounds.

The chemical delivery assemblies 200A or 200C may be "tuned" to fit the needs of the operator. In this respect, the use of a longer tubing 220 and surrounding screen 210 allows for a larger amount of pellets 230 (or more discs 230B or longer sticks 230D). This, in turn, may increase the life of the assembly 200A or 200C, thereby delaying the need for the well to be taken off-line and the assembly 200A or 200C to be pulled and reloaded. Of course, the amount of space available below the pump 170 may determine the length of continuous solid material that may be deployed.

Figure 2E:
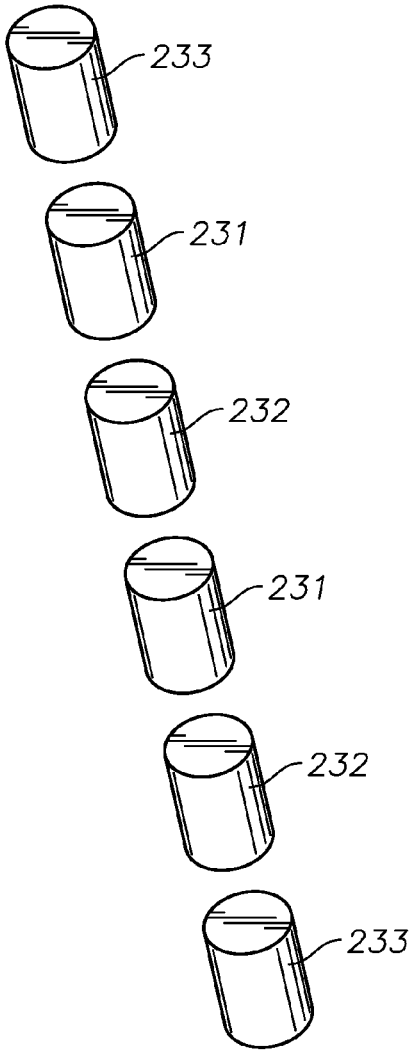
FIG. 2E provides a perspective view of a series of cylindrical chemical delivery sticks having different scale-inhibiting properties. The shorter sticks are designed to be stacked within the porous tubing of FIG. 2C.

FIG. 2E demonstrates one method for tuning the chemical delivery assembly 200C. FIG. 2E provides a perspective view of a series of cylindrical chemical delivery sticks having different scale-inhibiting properties. The "sticks" are designated as 231, 232 and 233.

In one aspect, sticks 231 may be formulated to treat primarily carbonate scales such as calcium carbonate or calcite [$CaCO_3$]. Sticks 232 may be formulated to treat primarily sulfate scales such as gypsum [$CaSO_4 2H_2O$] or anhydrite [$CaSO_4$] or calcium sulfate. Stick 233 may be formulated to primarily treat chloride scales such as sodium chloride [NaCl] or, alternatively, iron scales such as iron sulfide [FeS] or iron oxide [$Fe_2O_3$]. Any of these sticks may include the following known scale-inhibiting agents: phosphates, phosphate esters, phosphoric acid, phosphonates, phosphonic acid, polyacrylamides, salts of acrylamido-methyl propane sulfonate/acrylic acid copolymers (AMPS/AA), phosphinated maleic copolymers (PHOS/MA), salts of a polymaleic acid/acrylic acid/acrylamido-methyl propane sulfonate terpolymer (PMA/AMPS), sulfamic acids, or mixtures thereof.

By stacking all three sticks 231, 232, 233, different types of inhibitors may be employed simultaneously in the same wellbore.

In one aspect, more sticks of one type are deployed than of another type. In this way, the solid chemical treating material is customized for a particular well.

It is also noted that the discs 230B and sticks 230D (including sections 231, 232, 233) may be used to treat well conditions other than scale build-up. For example, the solid chemical material, or "stick," may be placed within a chemical delivery assembly to prevent wax build-up. This requires the placement of a paraffin inhibitor within the chemical "stick."

Paraffin inhibitors are used in petroleum production operations to reduce wax deposition along wellbore equipment and flow lines. The active chemistries of paraffin inhibitor products are specialty polymers that alter the wax crystallization process. This, in turn, changes the characteristics of wax deposits. The paraffin inhibitor may be, for example, a blend of surfactants with aromatic solvents. The surfactants may be either nonionic or anionic surfactants.

The discs 230B and sticks 230D (including sections 231, 232, 233) may also be used to prevent the growth of bacteria. This requires that the chemical "stick" have a solid and dissolvable biocide. The biocide, or bactericide, may be selected from the group consisting of, for example, formaldehyde, paraformaldehyde, glutaraldehyde, ammonia, quaternary ammonium compounds, sodium hypochlorite, phenols, and mixtures thereof.

In another embodiment, the continuous solid chemical material 230B or 230D (including sections 231, 232, 233) may also have a solid and dissolvable asphaltene inhibitor. Suitable asphaltene treatment chemicals include those such as alkylphenol ethoxylates and aliphatic polyethers.

Any of the above conditions may be treated by placing a suitably designed continuous solid material in the form of discs 230B or sticks 231, 232, 233 in the chemical delivery assemblies 200A, 200C.

Figure 3A:
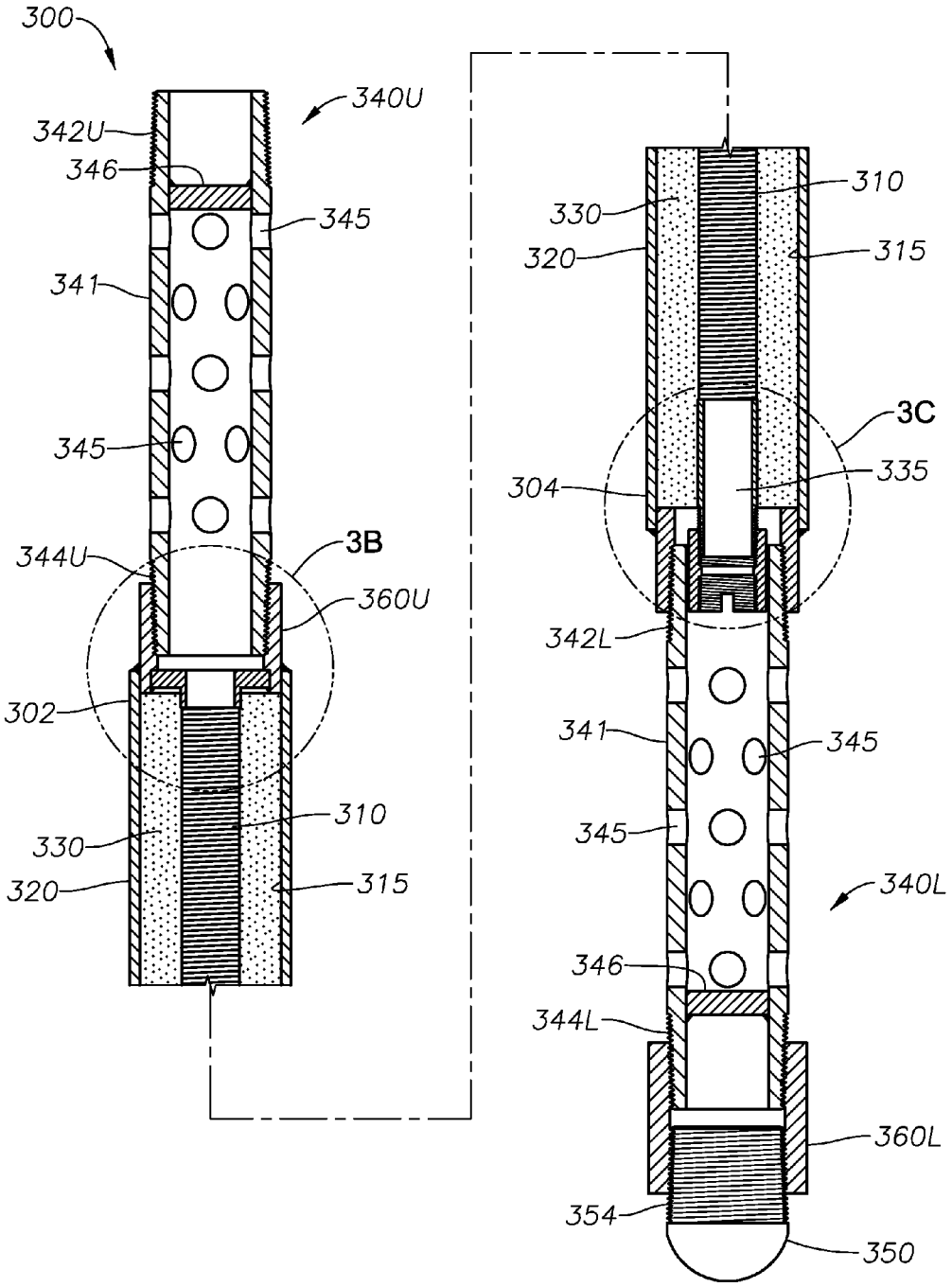
FIG. 3A is a side, cross-sectional view of a downhole chemical delivery assembly for treating wellbore components of the present invention, in an alternate embodiment.

Other arrangements for a chemical delivery assembly may be provided. FIG. 3A is a side, cross-sectional view of a downhole chemical delivery assembly 300 for treating wellbore components of the present invention, in an alternate embodiment. In this arrangement, a screen 310 is again provided. However, in this design the screen 310 resides substantially concentrically within a surrounding tubular body 320.

The tubular body 320 is preferably a joint of blank pipe. However, the tubular body 320 may also be another screen or a body having small perforations. In either event, an annular region 315 is formed between the screen 310 and the surrounding tubular body 320.

Residing within the annular region 315 is a chemical treating material 330. The chemical treating material 330 may again be in the form of pellets. Alternatively, the chemical treating material 330 may be shaped as discs as shown at 230B in FIG. 2B. One or more "discs" may be stacked over the screen 310 and in the annular region 315. The discs 230B may be fabricated from pyrophosphate (or phosphoric acid in solid phase) or other material known to remove scale. For calcium carbonate deposits, glycolic and citric acids and ammonium salts and blends incorporating EDTA may be used as chelation agents. Other chemicals such as sodium bisulfates and sulfamic acids may be used to treat a variety of well conditions as noted above.

The chemical delivery assembly 300 also has upper 340U and lower 340L tubing sections. The tubing sections 340U, 340L represent pipe bodies 341 that are perforated to provide fluid communication with the screen 310. Perforations are shown at 345. Fluids are then able to flow through the perforations 345, into a bore 335 of the screen, and outwardly through the screen 310. The fluids then contact the chemical treating material 330. In this way, the chemical treating material 330 may again be dissolved.

The upper tubing section 340U has an upper end 342U and a lower end 344U. The upper end 342U is threaded for connecting to a wellbore component such as a seating nipple or a string of production tubing. The lower end 344 is threaded for connecting to the upper end 302 of the tubular body 320. In another aspect, the entire assembly 300 is run in on a wireline and landed on a seating nipple. In this instance, the upper end 342U is configured to releasably connect to a wireline.

The lower tubing section 340L also has an upper end 342L and a lower end 344L. The upper end 342L is threaded for operatively connecting to the bottom 304 of the tubular body 320. The lower end 344L is threaded for operatively connecting to a bull plug 350.

The bull plug 350 contains threads 354 for operatively connecting with the lower end 344L of the lower tubing section 340L. In the arrangement of FIG. 3A, a threaded collar 360L provides female threads for receiving the threads at the lower end 344L of the lower tubing section 340L, and threads 354 of the bull plug 350 at the other end. Thus, the threaded collar 360L is a female-to-female connector. The bull plug 350 then seals the lower end 344L of the lower tubing section 340L.

The chemical delivery assembly 300 has a second threaded collar, shown at 360U. The threaded collar 360U provides female threads for receiving the threads at the lower end 344U of the upper tubing section 340U at one end, and the threads at the upper end 302 of the tubular body 320 at the opposite end.

Figure 3B:
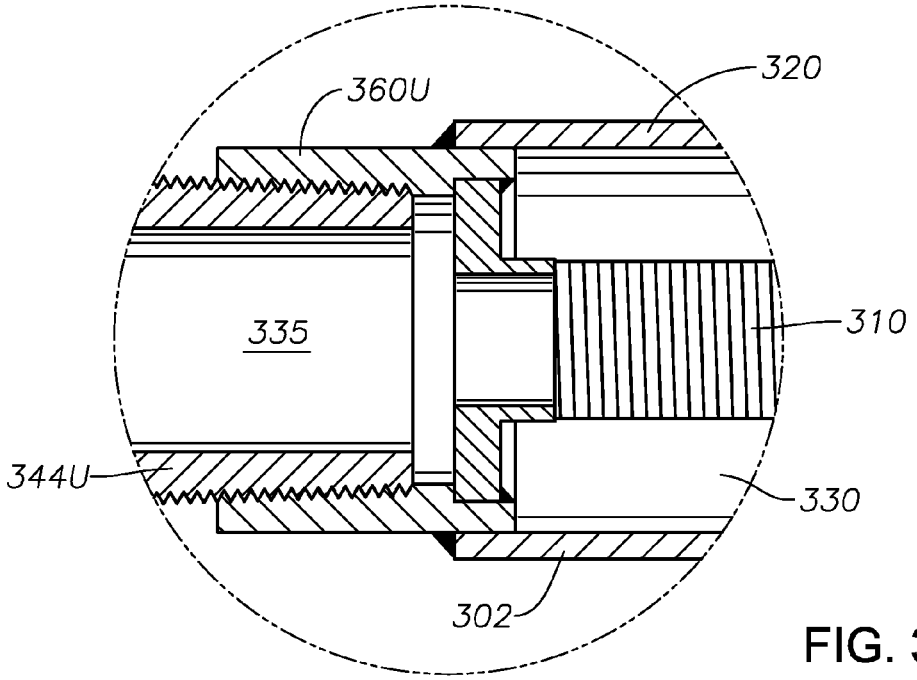
FIG. 3B is a side, cross-sectional view of a portion of the downhole chemical delivery assembly of FIG. 3A. The portion is from circle 3B of FIG. 3A.
Figure 3C:
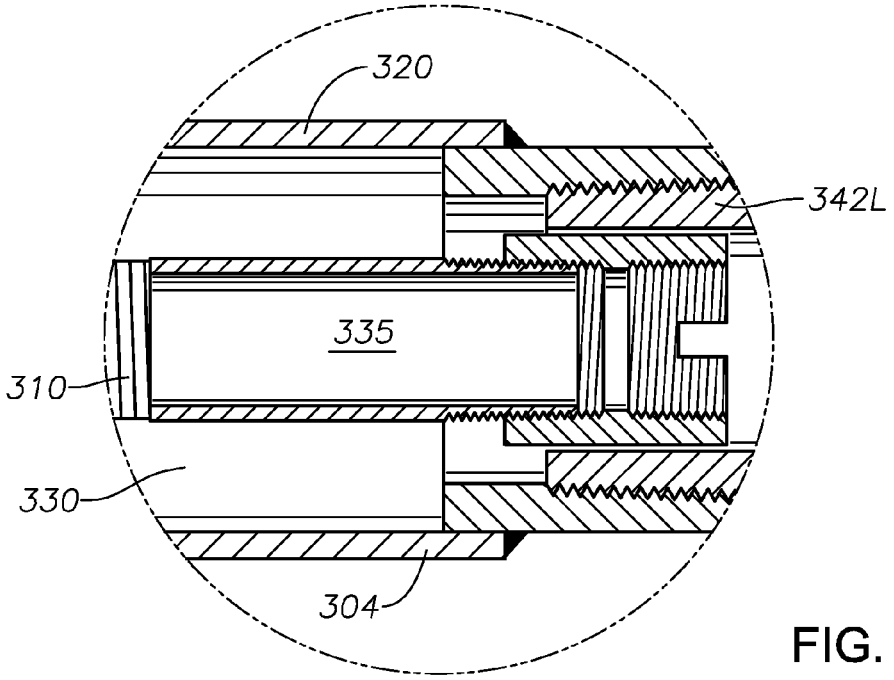
FIG. 3C is a side, cross-sectional view of another portion of the downhole chemical delivery assembly of FIG. 3A. The portion is from circle 3C of FIG. 3A.

The annular region 315 is sealed at the upper 302 and the lower 304 ends of the tubular body 320. FIGS. 3B and 3C provide enlarged views of the upper 302 and lower 304 ends, respectively.

FIG. 3B is a side, cross-sectional view of a portion of the downhole chemical delivery assembly 300 of FIG. 3A. The portion is from circle 3B of FIG. 3A at the upper end 302.

FIG. 3C is a side, cross-sectional view of another portion of the downhole chemical delivery assembly 300 of FIG. 3A. The portion is from circle 3C of FIG. 3A at the lower end 304.

FIGS. 3A, 3B and 3C all show a bore 335 that extends through the length of the chemical delivery assembly 300.

The upper tubing section 340U and the lower tubing section 340L each serve as a no-flow nipple. In this respect, the tubing sections 340U, 340L each include a blank plate 346. The plates 346 prevent the flow of fluids out of the upper 342U and lower 344L ends of the chemical delivery assembly 300. This, in turn, forces fluid communication with the annular region 315 to take place through the perforations 345 in the respective tubing sections 340U, 340L.

In the operational orientation shown in FIG. 3A, fluids are able to flow from the wellbore, through the perforations 345, and into the bore 335 of the screen 310. Reciprocally, fluids may flow out of the bore 335, through the perforations 345, and out of the tool 300. It is desirable to be able to seal the flow of fluid from the screen during transport. To do this, the orientations of the upper 340U and lower 340L tubing sections may be reversed so that the plates 346 are adjacent the upper 302 and lower 304 ends of the tubular body 320, respectively. In this way, the screen 310 is fluidically sealed for transport to or from a well site.

The chemical delivery assembly 300 may be modified by enlarging the diameter of the filter screen 310, and then placing the chemical treating material 330 within the bore 335 of the screen 310. A small annular region 315 would be preserved within the tubular body 320 to allow fluid flow. Such an arrangement is shown in FIG. 4A.

Figure 4A:
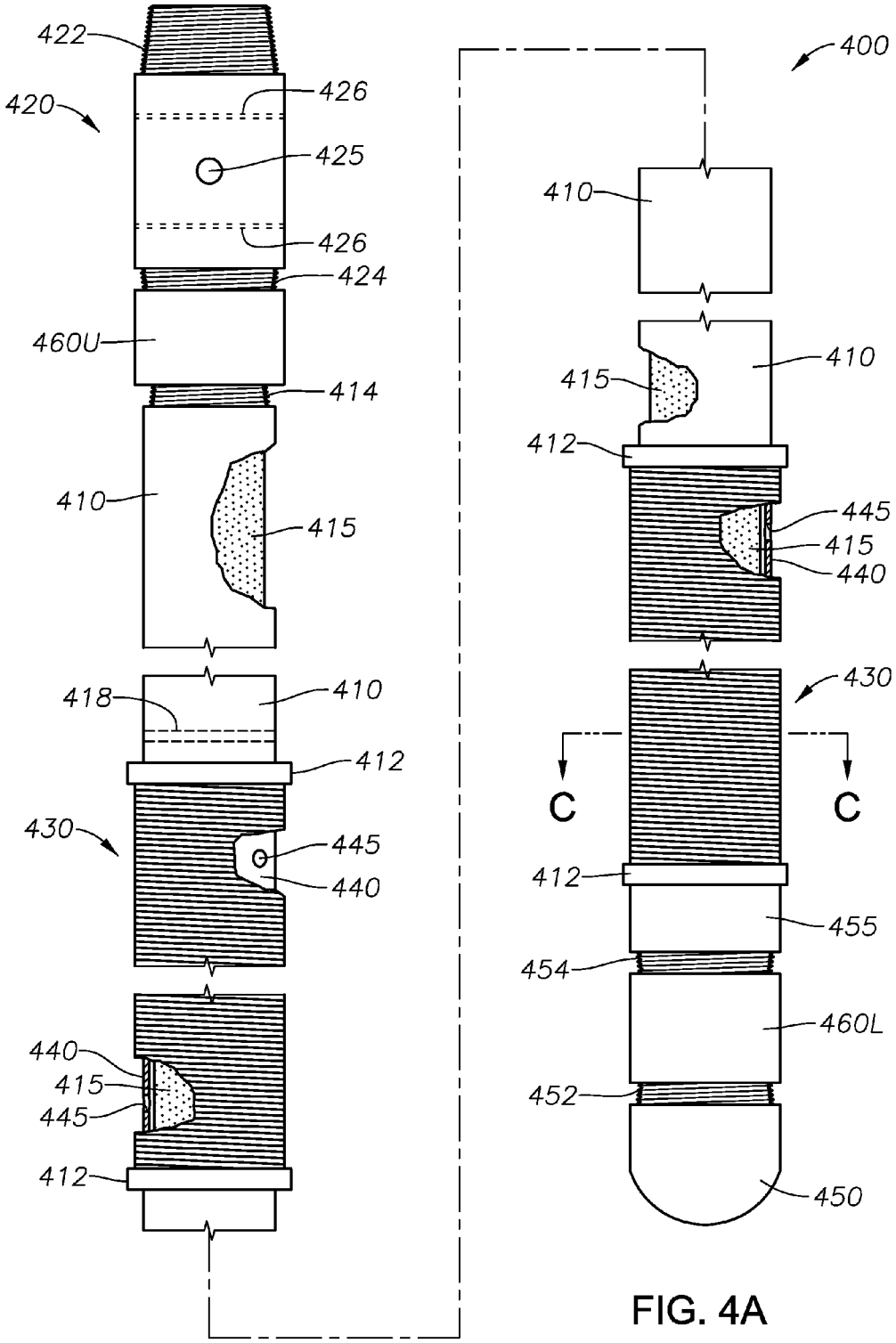
FIG. 4A provides a side view of a chemical delivery assembly, in an alternate embodiment. Here, elongated solid chemical "sticks" are placed within both blank pipe sections and perforated tubing sections along the assembly.

FIG. 4A provides a side view of a chemical delivery assembly 400, in an alternate embodiment. The assembly 400 first includes one or more joints of tubing 410. Preferably, tubing 410 is a single joint that is about 23.5 feet (7.16 meters) in length. Such tubing may have an inner diameter of, for example, 2⅜", 2½", or 2⅞". The tubing 410 will have at least one, and preferably two perforated sections 440. These are simply sections 440 where holes 445 have been drilled.

In the arrangement of FIG. 4A, an upper portion of blank tubing 410 is about 3 to 4 feet (0.91 to 1.22 meters) in length. This length is sufficient to allow a pipe pick-up machine to handle the assembly 400 at a well site. The upper portion of blank tubing 410 has a pin end comprised of threads 414. A traditional upset (not shown) is preferably provided adjacent the threads 414 to allow tongs to better support the assembly 400 over a wellbore.

A short section of perforated tubing 440 is provided just below the upper section of blank tubing 410. In one aspect, this upper perforated tubing 440 is about 1 foot (0.3 meters) in length. It may be referred to as a "vent." Because the two sections of tubing 410, 440 are actually the same piece of pipe, no threaded connection is required. However, in one aspect the two sections of tubing 410, 440 may be separate sections of tubing having a threaded connection.

Below the upper perforated tubing 440, or vent, is another section of blank tubing 410. This section is preferably about 10 to 20 feet (3.05 to 6.1 meters) in length. Then extending below this long section of blank tubing 410 is a lower perforated section 440. This lower perforated section 440 is preferably about 2 feet (0.6 meters) in length. Again, the blank tubing sections 410 and the perforated tubing sections 440 are preferably all the same joint of tubing, with two sections being slotted to allow fluid communication by wellbore fluids internal to the tubing 440.

In another aspect, the assembly 400 includes a combination of blank tubing joints 410 and perforated tubing joints 440 that are threadedly connected. In this instance, the assembly 400 may be between about 30 and 100 feet (9.14 and 30.48 meters) in length. In either aspect, the tubing 410/440 holds elongated solid chemical "sticks" 415. The chemical sticks 415 are solid cylindrical bodies such as chemical sticks 230D of FIG. 2D.

In FIG. 4A, portions of the blank tubing joints 410 have been cut away. This reveals portions of solid chemical treating material 415 therein. The chemical treating material 415 may define, for example, a 1 foot, a 10 foot, or a 20 foot (0.31, 3.05 or 6.1 meter) cylindrical body. In one aspect, the combined tubing 410/440 sections are about 24 feet (7.32 meters) in length, and are pre-loaded with three, 8-foot (2.44 meters) solid chemical sticks 415.

Figure 4B:
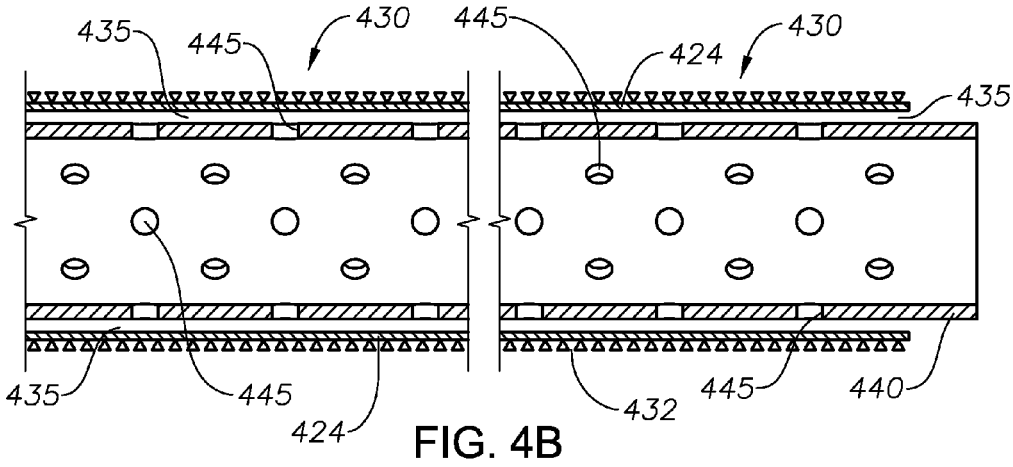
FIG. 4B provides a cross-sectional view of the perforated tubing of the chemical delivery assembly of FIG. 4A. A wire screen is shown supported around the perforated tubing.
Figure 4C:
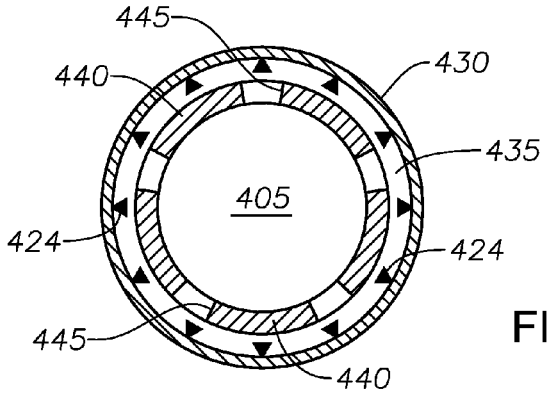
FIG. 4C provides another cross-sectional view of the perforated tubing of the chemical delivery assembly of FIG. 4A. Here, the view is cut across line C-C of FIG. 4A.

A perforated tubing section 440 is more clearly seen in the cross-sectional views of FIGS. 4B and 4C. FIG. 4B provides a cross-sectional view of a perforated tubing section 440 taken along a longitudinal axis of the chemical delivery assembly 400. FIG. 4C provides another cross-sectional view of the perforated tubing 440. Here, the view is cut across line C-C of FIG. 4A. (Note that the chemical stick 415 has been removed for illustrative purposes.)

Referring to FIGS. 4B and 4C together, it can be seen that the perforated tubing 440 represents a tubular body having a bore 405 therein. Perforations 445 (or drilled slots) are provided along the tubing 440. The perforations 445 provide fluid communication between the bore 405 of the tubing 440 and the surrounding subsurface formation (shown at 50 in FIG. 1).

The perforated tubing 440 is surrounded by a wire screen 430. The wire screen 430 is preferably a so-called "v" screen, wherein wire having a "v" profile is wound around the tubing 440. The wire screen 430 is supported by a series of longitudinal ribs 424 that are welded in place. The result is a series of micro-slots 432 that are sized to permit an ingress of fluids but to keep out sands and fines of a selected diameter.

A small annulus 435 is formed between the perforated tubing 440 and the surrounding screen 430. The annulus 435 permits fluid flow along the longitudinal axis of the screen 430. However, opposing ends of the screen 430 are sealed using end collars 412. The end collars 412 define welded rings.

It is noted that the size of the slots 432 and the size of the annulus 435 may be adjusted to control the amount of fluid that flows into the bore 405 of the perforated tubing 440. This, in turn, controls the rate of dissolution of the solid chemical stick 415. Preferably, the slots 432 are about 0.006 to 0.075 inches in width. A smaller width will decrease the rate of dissolution of the solid chemical treating material 415.

The lower perforated tubing section 440 and surrounding screen 430 may be between about 2 feet and 10 feet (0.61 and 3.05 meters) in length for significant producing wells. Joints of perforated tubing 440 and screen 430 may be connected end-to-end to increase the length of the perforated tubing section 440 with screen 430. This would be for the purpose of housing greater lengths of the solid chemical stick 415 within bore 405.

On the other hand, for so-called stripper wells that produce only small volumes of reservoir fluids each day, the combined perforated tubing 440 and surrounding screen 430 may be between about 1 foot and 3 feet (0.3 and 0.91 meters). In one embodiment, the entire assembly 400 is only eight feet in length and may be shipped to a customer via courier with the chemical stick 415 pre-loaded. Such a scaled-down assembly may also be beneficial for de-watering gas wells. In this respect, caustic components in the water and even in the gas can scale up perforations.

Referring back to FIG. 4A, an upper blank tubing section 410 is optionally connected to a no-flow nipple 420. The no-flow nipple 420 has a threaded upper end 422 for connecting to a landing nipple or production tubing 160 in a wellbore. The no-flow nipple 420 also has a lower end 424 for threadedly connecting with an upper half-collar 460U. The upper half-collar 460U serves as a male-to-male connector for connecting the no-flow nipple 420 to the upper blank pipe joint 410 via threads 414. Preferably, the upper half-collar 460U is a standard full EUE 8 round collar.

The no-flow nipple 420 also has a through-opening 425 drilled through it. The through-opening 425 resides between two blank plates 426. The blank plates 426 are shown in phantom in FIG. 4A. The plates 426 prevent the flow of fluids out of the upper end of the assembly 400.

A lower end of the chemical delivery assembly 400 is sealed using a plug 450. In the view of FIG. 4A, the plug 450 is a bull plug. The bull plug 450 includes male threads 452. The bull plug 450 is connected to a bottom screen 430 through a lower half collar 460L. In the view of FIG. 4A, the half collar 460L is a male-to-male connector that connects the threads 452 of the bull plug 450 to threads 454 of a screen connector 455. However, in another embodiment the lower half-collar 460L is welded on. To accomplish this, the lower (pin) end of the tubing is cut off.

In one aspect, the bull plug 450 is specially designed to present a uniform profile. Most bull plugs have a lip that extends out over the threads. However, the bull plug 450 of FIG. 4A meets flush with the outer diameter of the half collar 460L. In another aspect, the lower plug 450 is a blank disc that is screwed into the lower half collar 460L, preferably using a keyed tool. Alternatively, a socket-weld collar and a blank disc (not shown) are used to seal the lower end of the chemical delivery assembly 400.

As can be seen improved chemical delivery assemblies for inhibiting the build-up of paraffin, scale and corrosion are provided. The use of the assemblies 200A, 200C, 300 and 400 may reduce the frequency of pulling tubing due to corroded pipe, corroded rods, or corroded pumps. In addition, the use of the assemblies 200A, 200C, 300 and 400 may reduce the frequency of stuck plungers in plunger lift systems.

In any of the above compositions, portions of chemical treating material 415 may be designed to have different dissolution rates. This means that different sticks having different dissolution rates may be placed along the chemical delivery assembly 400. This serves to both "smooth out" the dissolution rate and extend the life of the treating material in the wellbore.

Referring back to FIG. 2E, sticks 231, for example, may be designed to dissolve quickly, such as over a first 120 day period in a wellbore. Sticks 232 may have a membrane coating on them that delays exposure to reservoir fluids, causing the sticks 232 to dissolve primarily over a second 120 day period. The membrane may be a thin polymer coat that dissolves slowly in the presence of the slightly acidic reservoir fluids. Sticks 233 may be comprised of a separate material that dissolves more slowly, such as over a 240 day period. In this way, the wellbore is being continuously treated for a particular type of scale over an 8-month period.

Figure 5:
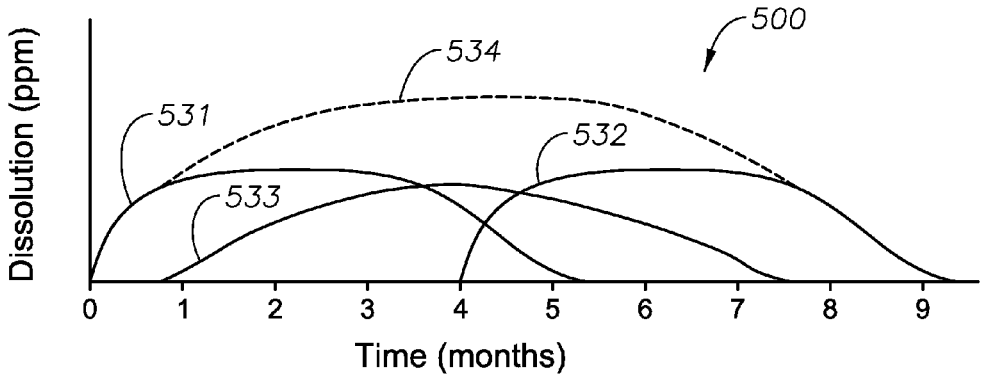
FIG. 5 provides a Cartesian coordinate. Time (in months) is shown on the "x"-axis, while dissolution (in parts per million) is plotted along the "y"-axis.

FIG. 5 provides a Cartesian coordinate 500. Time (in months) is shown on the "x"-axis, while dissolution (in parts per million) is plotted along the "y"-axis. Line 531 presents an illustrative dissolution rate for chemical stick 231; line 532 presents an illustrative dissolution rate for chemical stick 232; and line 533 presents an illustrative dissolution rate for chemical stick 233 of FIG. 2E. Dissolution rates may be, for example, between about 25 ppm and 150 ppm.

In FIG. 5, a fourth line is shown at 534. The fourth line 534 is dashed, and represents a sum of the values (dissolution rates) for lines 531, 532 and 533. Line 534 demonstrates a smoothing effect from having three different chemical sticks 231, 232, 233 having different dissolution rates.

In FIG. 5, lines 531 and 532 suggest an effective life of about 5 months for the first 231 and second 232 chemical sticks, while line 533 suggest an effective life of about 6 months for a third 233 chemical stick 233. It is understood that these life spans are merely illustrative, and that ideally a life span of 8 to 12 months would be provided.

As an alternative, lines 531, 532 and 533 may all represent chemical sticks that have the same rate of dissolution. However, the chemical stick of line 531 may reside along a perforated tubing having surrounding screen slots dimensioned to permit a first fluid flow rate that increases the dissolution rate. On the other hand, the chemical stick of line 533 may reside along a perforated tubing having surrounding screen slots dimensioned to permit a second fluid flow rate that decreases the dissolution rate. Then, the chemical stick of line 532 may reside along the blank pipe joints 510, wherein reservoir fluids do not significantly reach the chemical sticks until the chemical stick of line 531, the chemical stick of line 532, or both have been substantially dissolved. Alternatively or in addition, a dissolvable membrane may be placed at an end of a blank pipe joint 510 that protects the chemical stick from exposure to reservoir fluids for a designated period of time. Such a membrane is shown in phantom at 418 in FIG. 4A.

As an alternative to adjusting screen slot sizes 435 or adjusting the dissolution rate of a solid chemical treating material 415 or using a membrane 418, a chemical delivery assembly may have an inflow control device. In one aspect, the inflow control device is electrically powered, and borrows power from a power cord associated with an electrical submersible pump, or ESP.

While it will be apparent that the inventions herein described are well calculated to achieve the benefits and advantages set forth above, it will be appreciated that the inventions are susceptible to modification, variation and change without departing from the spirit thereof. Certain embodiments of the inventions are presented in the claims, which follow.

I claim:

1. A downhole assembly for delivering chemical treatment to a wellbore, comprising:

a first tubular body;

a second tubular body residing substantially concentrically within the first tubular body, the second tubular body being porous to provide fluid communication between the first tubular body and a bore within the second tubular body;

an annular region between the second tubular body and the surrounding first tubular body;

a chemical treating material, wherein:

the chemical treating material is in solid phase but is dissolvable upon contact with a wellbore fluid and is designed to (i) inhibit a build-up of precipitate on components in the wellbore, (ii) remove scale on components in the wellbore, (iii) prevent a build-up of bacteria in the wellbore, (iv) prevent a build-up of paraffin in the wellbore, or (v) combinations thereof;

the chemical treating material resides within either a bore of the second tubular body or the annular region around the second tubular body; and the chemical treating material is a continuous solid material in the shape of one or more discs; and the discs reside in the annular region between the second tubular body and the surrounding first tubular body; and the second tubular body is a perforated tubing; and the surrounding first tubular body is a wire-wrapped screen having slots dimensioned to control a rate of dissolution of the solid chemical treating material.

2. The downhole assembly of claim 1, wherein the solid chemical treating material comprises one or more discs having a first rate of dissolution, and one or more discs having a second rate of dissolution that is slower than the first rate of dissolution, with the discs being stacked in the annular region.

3. The downhole assembly of claim 1, wherein:

the second tubular body defines a screen having slots;

the first tubular body defines a blank pipe; and the downhole assembly further comprises:

an upper perforated tubular section having a bore, the bore being in fluid communication with the bore of the screen, and the upper perforated tubular being operatively connected to a first end of the screen;

a lower perforated tubular section having a bore, the bore also being in fluid communication with the bore of the screen, and the lower perforated tubular body being operatively connected to a second opposite end of the screen.

4. The downhole assembly of claim 1, wherein the downhole assembly is sealed at opposing ends.

5. The downhole assembly of claim 1, wherein: the chemical treating material is a continuous solid material in the shape of one or more cylinders; and the cylinders reside in the bore of the second tubular body.

6. The downhole assembly of claim 5, wherein: the second tubular body is a perforated tubing; and the surrounding first tubular body is a wire-wrapped screen having slots dimensioned to control a rate of dissolution of the solid chemical treating material.

7. The downhole assembly of claim 6, wherein the solid chemical treating material comprises one or more cylinders having a first rate of dissolution and one or more cylinders having a second rate of dissolution that is slower than the first rate of dissolution.

8. The downhole assembly of claim 6, wherein the assembly resides within a wellbore below a downhole pump.

9. The downhole assembly of claim 6, further comprising: a bull plug at a lower end of the screen to seal the lower end of the downhole assembly to fluid flow.

10. The downhole assembly of claim 6, further comprising: a no-flow nipple or a collar with a blank plate at an upper end of the downhole assembly to seal the upper end of the downhole assembly to fluid flow.

11. The downhole assembly of claim 6, further comprising: a section of blank tubing disposed at an end of the second tubular body and having a bore that is in fluid communication with the bore of the second tubular body; wherein the bore of the section of blank pipe contains one or more cylinders of the chemical treating material.

12. The downhole assembly of claim 5, wherein:

the second tubular body comprises a first perforated section and a second perforated section;

the surrounding first tubular body comprises a wire-wrapped screen having slots dimensioned to control a rate of dissolution of the solid chemical treating material, with a first portion of wire-wrapped screen being placed around the first perforated section, and a second portion of wire-wrapped screen being placed around the second perforated section;

the downhole assembly further comprises a section of blank tubing disposed between the first perforated section and the second perforated section;

the section of blank tubing, the first perforated section and the second perforated section are all part of a same joint of tubing sharing a same bore, with the bore containing one or more cylinders of the solid chemical treating material.

13. A downhole assembly for delivering chemical treatment to a wellbore, comprising:

a first tubular body defining a wire-wrapped screen;

a second tubular body residing substantially concentrically within the first tubular body, the second tubular body defining a section of perforated tubing that provides fluid communication between the first tubular body and a bore within the second tubular body;

a plug at a lower end of the second tubular body providing a fluid seal to a bottom of the downhole assembly;

a first section of blank pipe disposed at an upper end of the second tubular body and having a bore that is in fluid communication with the bore of the second tubular body; and a chemical treating material, wherein:

the chemical treating material is in a solid phase but is dissolvable upon contact with a wellbore fluid and is designed to (i) inhibit a build-up of precipitate on components in the wellbore, (ii) remove scale and corrosion on components in the wellbore, (iii) prevent a build-up of bacteria in the wellbore, (iv) prevent a build-up of paraffin in the wellbore, or (v) combinations thereof;

the chemical treating material resides within the bore of the second tubular body and in the bore of the section of blank pipe; and the chemical treating material is in the form of two or more substantially solid cylinders.

14. The downhole assembly of claim 13, further comprising: a no-flow nipple or a collar with a blank disc at an upper end of the downhole assembly to seal the upper end of the downhole assembly.

15. The downhole assembly of claim 14, wherein the assembly resides within a wellbore below a downhole pump.

16. The downhole assembly of claim 13, wherein the solid chemical treating material comprises one or more cylinders having a first rate of dissolution and one or more cylinders having a second rate of dissolution that is slower than the first rate of dissolution.

17. The downhole assembly of claim 16, wherein the solid chemical treating material comprises one or more cylinders having a dissolvable membrane to delay dissolution of the solid chemical treating material.

18. The downhole assembly of claim 16, wherein the wire-wrapped screen comprises slots dimensioned to control a rate of dissolution of the solid chemical treating material within the second tubular body.

19. The downhole assembly of claim 13, wherein: the section of blank pipe and the second tubular body are part of a same joint of tubing sharing a same bore, with the bore containing one or more cylinders of the solid chemical treating material.

20. The downhole assembly of claim 19, further comprising: a vent above the section of blank pipe, the vent comprising a section of perforated tubing forming a bore, and a wire-wrapped screen around the section of perforated tubing; and wherein the section of perforated tubing in the vent and the first section of blank pipe are part of a same joint of tubing sharing a same bore.

21. The downhole assembly of claim 20, further comprising: a second section of blank pipe residing between a no-flow nipple or a collar with a blank disc, and the vent; and wherein the chemical treating material further resides within the bore of the perforated tubing within the vent.

22. A method of treating a wellbore using a solid treating material, comprising:

running a downhole assembly into a wellbore, the downhole assembly comprising:

a first tubular body;

a second tubular body residing substantially concentrically within the first tubular body, the second tubular body being porous to provide fluid communication between the first tubular body and a bore within the second tubular body;

an annular region between the second tubular body and the surrounding first tubular body;

a chemical treating material, wherein:

the chemical treating material is in solid phase but is dissolvable upon contact with a wellbore fluid and is designed to (i) inhibit a build-up of precipitate on components in the wellbore, (ii) remove scale and corrosion on components in the wellbore, (iii) prevent a build-up of bacteria in the wellbore, (iv) prevent a build-up of wax or paraffin in the wellbore, or (v) combinations thereof;

the chemical treating material resides within either the second tubular body or the annular region around the second tubular body; and the chemical treating material is a continuous solid material in the shape of one or more discs; and the discs reside in the annular region between the second tubular body and the surrounding first tubular body; and the second tubular body is a perforated tubing; and the surrounding first tubular body is a wire-wrapped screen having slots dimensioned to control a rate of dissolution of the solid chemical treating material.

23. The method of claim 22, wherein the solid chemical treating material comprises one or more discs having a first rate of dissolution and one or more discs having a second rate of dissolution that is slower than the first rate of dissolution, with the discs being stacked in the annular region.

24. The method of claim 22, wherein: the chemical treating material is a continuous solid material in the shape of one or more cylinders; and the cylinders reside in the bore of the second tubular body.

25. The method of claim 24, wherein: the second tubular body is a perforated tubing; and the surrounding first tubular body is a wire-wrapped screen having slots dimensioned to control a rate of dissolution of the solid chemical treating material.

26. The method of claim 25, wherein the assembly resides within the wellbore below a downhole pump.

27. The method of claim 26, wherein the solid chemical treating material comprises one or more cylinders having a first rate of dissolution and one or more cylinders having a second rate of dissolution that is slower than the first rate of dissolution.

28. The method of claim 25, further comprising: a bull plug or a blank disc at a lower end of the screen to seal a lower end of the downhole assembly.

29. The method of claim 25 further comprising: a reversible no-flow nipple or a collar having a blank disc at an upper end of the downhole assembly to seal the upper end of the downhole assembly.

30. The method of claim 24, further comprising: a section of blank pipe disposed at an end of the second tubular body and having a bore that is in fluid communication with the bore of the second tubular body; wherein the bore of the section of blank pipe contains one or more cylinders of the chemical treating material.

31. The method of claim 22, further comprising: threadedly connecting the downhole assembly to the lower end of a seating nipple or a joint of production tubing as part of running the downhole assembly into the wellbore.

32. The method of claim 31, further comprising: producing hydrocarbon fluids from the wellbore.

33. The method of claim 25, further comprising: determining a slot width that correlates to a dissolution rate of the chemical treating material in the wellbore.

34. The method of claim 33, wherein the slot width is between about 0.006 and 0.075 inches.

35. The method of claim 30, wherein: the section of blank pipe is between about 2 and 20 feet (0.61 and 6.1 meters) in length; and the second tubular body is between about 6 inches and 10 feet (0.15 and 3.05 meters) in length.

36. The method of claim 35, further comprising: providing one or more cylinders of solid chemical material having a first rate of dissolution; and providing one or more cylinders of solid chemical material having a second rate of dissolution that is slower than the first rate of dissolution.

37. The method of claim 36, further comprising: placing at least one of the one or more cylinders having a first rate of dissolution in the bore of the second tubular body; and placing at least one of the one or more cylinders having a second rate of dissolution in the bore of the second tubular body.

38. The method of claim 30, wherein: the second tubular body comprises a first perforated section and a second perforated section; the surrounding first tubular body comprises a wire-wrapped screen having slots dimensioned to control a rate of dissolution of the solid chemical treating material, with a first portion of wire-wrapped screen being placed around the first perforated section, and a second portion of wire-wrapped screen being placed around the second perforated section; the downhole assembly further comprises a section of blank tubing disposed between the first perforated section and the second perforated section; the section of blank tubing, the first perforated section and the second perforated section are all part of a same joint of tubing sharing a same bore, with the bore containing one or more cylinders of the solid chemical treating material.

39. The method of claim 38, further comprising: a vent above the section of blank tubing, the vent comprising a section of perforated tubing forming a bore, and a wire-wrapped screen around the section of perforated tubing; and wherein the section of perforated tubing in the vent and the section of blank tubing are part of a same joint of tubing sharing a same bore.

* * * * *